US005286359A

United States Patent [19]

Richards et al.

[11] Patent Number: 5,286,359

[45] Date of Patent: Feb. 15, 1994

[54] ALUMINA REDUCTION CELL

[75] Inventors: Nolan E. Richards, Florence; Alton T. Tabereaux, Colbert County, both of Ala.

[73] Assignee: Reynolds Metals Company, Richmond, Va.

[21] Appl. No.: 703,439

[22] Filed: May 20, 1991

[51] Int. Cl.[5] ..... C25C 3/08; C25C 3/10; C25C 3/12

[52] U.S. Cl. ..... 204/243 R; 204/244; 204/286; 204/291; 204/294

[58] Field of Search ..... 204/67, 243 R-247, 204/294, 64 R, 291, 292, 293

[56] References Cited

U.S. PATENT DOCUMENTS

| | | | |
|---|---|---|---|
| 3,067,124 | 12/1962 | DePava | 204/244 |
| 3,909,375 | 9/1975 | Holliday et al. | 204/64 R |
| 3,930,967 | 1/1976 | Alder | 204/67 |
| 3,930,968 | 1/1976 | Cramer et al. | 204/294 X |
| 4,071,420 | 1/1978 | Foster, Jr. et al. | 204/67 |
| 4,177,128 | 12/1979 | Rahn | 204/243 R |
| 4,308,114 | 12/1981 | Das et al. | 204/67 |
| 4,342,637 | 8/1982 | Withers et al. | 204/294 X |
| 4,405,433 | 9/1983 | Payne | 204/225 |
| 4,526,669 | 7/1985 | Joó et al. | 204/243 R |
| 4,529,494 | 7/1985 | Joó et al. | 204/290 R |
| 4,596,637 | 6/1986 | Kozarek et al. | 204/64 R X |
| 4,602,990 | 7/1986 | Boxall et al. | 204/243 R |
| 4,605,481 | 8/1986 | Langon | 204/243 R X |
| 4,613,414 | 9/1986 | Sivilotti et al. | 204/245 X |
| 4,664,760 | 5/1987 | Jarrett | 204/67 |
| 4,707,239 | 11/1987 | Murphy et al. | 204/294 X |
| 5,006,209 | 4/1991 | Beck et al. | 204/243 R X |

OTHER PUBLICATIONS

Kasherman et al., "Anode Current Density Distributionin an Aluminium Electrolysis Cell with Sloping Electrodes", *Aluminium*, Dec., 1990.

Shekhar, R. et al., "Modeling Studies of Electrolyte Flow and Bubble Behavior in Advanced Hall Cells", *Light Metals 1990*, 1990.

Dorward, R. C., "Energy Consumption of Aluminium Smelting Cells Containing Solid Wetted Cathodes", *Journal of Applied Electrochemistry*, 13, 1983.

*Primary Examiner*—Donald R. Valentine

*Attorney, Agent, or Firm*—Alan T. McDonald

[57] ABSTRACT

An electrolysis cell for producing metals by electrolytic reduction of molten baths which includes non-consumable inert anodes and refractory hard metal cathode elements. The cathode elements are replaceably mounted in the electrolysis cell and have inclined planar working surfaces which have grooves therein. A method for producing metals by use of the electrolysis cell includes utilizing the grooves to control the release of anode gases.

10 Claims, 2 Drawing Sheets

ALUMINA REDUCTION CELL

TECHNICAL FIELD

The present invention relates to an electrolytic cell for the manufacture of metals by electrolysis of their respective molten electrolytes. More particularly, the present invention relates to an improved anode-cathode structure for electrolytic cells which are useful in the production of aluminum from a molten cryolite bath.

BACKGROUND ART

Electrolysis involves an electrochemical oxidation-reduction reaction associated with the decomposition of a compound. In an electrolysis cell an electrical current passes between two electrodes and through an electrolyte, which can be the compound alone, e.g., sodium chloride or the compound dissolved in a liquid solvent, e.g., aluminum dissolved in cryolite, such that a metallic constituent of the compound is reduced together with a corresponding oxidation reaction. The current is passed between the two electrodes from an anode to a cathode to provide electrons at a requisite electromotive force to reduce the metallic constituent which usually is the desired electrolytic product, such as in the electrolytic smelting of metals. The electrical energy expended to produce the desired reaction depends upon the nature of the compound and the composition of the electrolyte. However, in practical application, the cell power efficiency of a particular electrolytic or reduction cell design can result in wasted energy depending on factors such as, inter alia, cell voltage and current efficiency.

Generally speaking, aluminum is produced by electrolysis of aluminum compounds such as aluminum oxides or salts or other compounds in a molten salt bath. Typically, aluminum is produced by the Hall-Heroult electrolytic production process wherein aluminum oxide dissolved in molten cryolite is electrolyzed at a temperature of from 900° C. to 1000° C. During the reduction process molten aluminum is electrolyzed out of the aluminum oxide-cryolite melt and is periodically or continually withdrawn from the reduction cell.

A commonly utilized reduction cell for the manufacture of aluminum is the classic Hall-Heroult design, which utilizes carbon electrodes and a substantially flat carbon-lined bottom which functions as part of the cathode system. An electrolyte typically used in the production of aluminum by electrolytic reduction of alumina consists primarily of molten cryolite with dissolved alumina which may contain other materials such as fluorspar, aluminum fluoride, and other metal fluoride salts.

Molten aluminum resulting from the reduction of alumina is most frequently permitted to accumulate in the bottom of the receptacle forming the reduction cell, as a molten melt pad or pool over the carbon-lined bottom thus forming a liquid metal cathode. Carbon anodes extending into the receptacle and contacting the molten electrolyte are adjusted relative to the liquid metal cathode. Current collector bars such as steel are generally imbedded in the carbon line cell bottom and complete the connection through the cathodic system.

While the design and sizes of Hall-Heroult reduction cells vary, all have relatively low energy efficiencies, ranging from about 35 to about 45%, depending upon cell geometry and mode of operation. Thus, while the theoretical power requirement to produce one pound of aluminum is 2.85 kw hours, in practice power usages range from 6 to 8.5 kw hours per pound of aluminum with an industry average of about 7.5 kw hours per pound of aluminum.

Much of the voltage drop through a reduction cell occurs in the electrolyte and is attributable to electrical resistance of the electrolyte, or electrolytic bath, across the anode-cathode distance. The bath electrical resistance or voltage drop in conventional Hall-Heroult cells for the electrolytic reduction of aluminum from alumina dissolved in a molten cryolite bath includes a decomposition potential, i.e. energy in aluminum production and an additional voltage attributable to heat energy generated in the inter-electrode spacing by the bath resistance, which heat energy generally is discarded. Such discarded heat energy typically makes up 35 to 40% of the total voltage drop across the cell, and in comparative measure, as much as up to twice the voltage drop attributable to decomposition potential.

To minimize voltage drop and optimize cell efficiency the gap between the anode and surface of the aluminum pad should be maintained as small as possible, preferably not more than about 3 cm. This desirable close anode-cathode spacing is difficult to maintain during the magnetic induction currents which cause large perturbations in the molten aluminum pad which increases the risk of short circuiting the system by contact between the molten aluminum and the anode. For example, in a typical cell the spacing between the anode and surface of the molten aluminum cannot, as a practical manner, be maintained at less than about 4 cm.

Reducing the anode-cathode separation distance is one way to decrease energy loss. However, whenever the anode-cathode distance is reduced, short circuiting of the anode and cathode must be prevented. In minimizing the space between the anode and cathode, displacement of the metal in the aluminum pad caused by magnetic forces associated with the electrical currents employed in electrolysis must be carefully considered. Thus, to prevent shortening the anode-cathode separation must always be slightly greater than the peak height of the displaced molten product in the cell.

Another adverse effect which results from reducing the anode-cathode distance is a significant reduction in current efficiency of the cell when the metal produced by the electrolysis at the cathode is oxidized by contact with the anode product. For example, in the electrolysis of aluminum from alumina dissolved in cryolite, aluminum metal produced at the cathode can be oxidized readily back to alumina or aluminum salt by close proximity to the anodically produced carbon oxide. A reduction in the anode cathode separation distance provides more contact between the anode product and the cathode product and significantly accelerates the reoxidation of reduced metal, thereby decreasing current efficiency.

A consumable anode, such as the carbon anode conventionally used in the production of aluminum in a conventional reduction cell presents a substantial obstacle in achieving a precise control of the interelectrode spacing. In the conventional reduction cell oxygen gas produced at the anode combines with the carbon of the anode itself to form carbon oxide, such as carbon monoxide and carbon dioxide gas. Oxidation of the anodes together with air burning of the anodes consumes about 0.45 pounds of carbon for each pound of aluminum produced. This carbon loss necessitates careful monitoring of the anode height and frequent adjustment in conventional reduction cell practice.

Refractory hard metals (RHM) were first utilized for cathode constructions in aluminum reduction cells in the early 1950's. RHM materials in pure form are very resistant to molten alumina in cryolite found in an aluminum reduction cell and, moreover, generally have higher electrical conductivities than the conventional carbon products used in reduction cells. Additionally, RHM materials, and particularly $TiB_2$, are readily wet by molten aluminum, whereas carbon products normally used are not.

Although the early use of RHM materials in aluminum reduction cells was conceptionally a significant improvement, such use was fraught with practical problems and, as a result, the development of RHM cathodes has only recently led to any significant use of these materials in reduction cells.

The present invention is an improvement over previous RHM cathode elements and associated reduction cells which allows for operation of commercial cells at significantly reduced anode-cathode separation distances without reducing the cell current efficiency, while at the same time significantly reducing the specific energy consumption.

DISCLOSURE OF THE INVENTION

It is accordingly one object of the present invention to provide a reduction cell which allows for improved energy efficiency during operation.

Another object of the present invention is to provide a reduction cell that includes a unique configuration of inert anodes and RHM cathodes.

A further object of the present invention is to provide for an RHM cathode which has a unique configuration which provides for controlled release of anode gases and increased mass transfer of alumina into a reduction cell's reaction zones.

A still further object of the present invention is to provide RHM cathode elements which are held in position in reduction cells in a manner which improves the stability of the RHM cathode element's positioning in the cathode.

A still further object of the present invention is to provide a method of producing aluminum utilizing a novel reduction cell design.

According to the present invention there is provided refractory hard metal (RHM) cathode elements which are held in a reduction cell by means of ceramic holders. These RHM cathode elements have inclined surfaces with grooves located therein which provide for controlled release of anode gases at a reduced anode-cathode cell operation to effectively reduce cell resistance due to anode gases. The grooves further increase the mass transfer of alumina into the cell's reaction zones.

According to the novel reduction cell design, the RHM cathodes are configured in a position in relationship to inert anodes so as to significantly reduce anode-cathode separation distance, thereby increasing the overall efficiency of the electrolytic cell.

BRIEF DESCRIPTION OF THE DRAWINGS

The present invention will now be described with reference to the annexed drawings, which are given by way of non-limiting examples only.

BEST MODE FOR CARRYING OUT THE INVENTION

Figure 1:
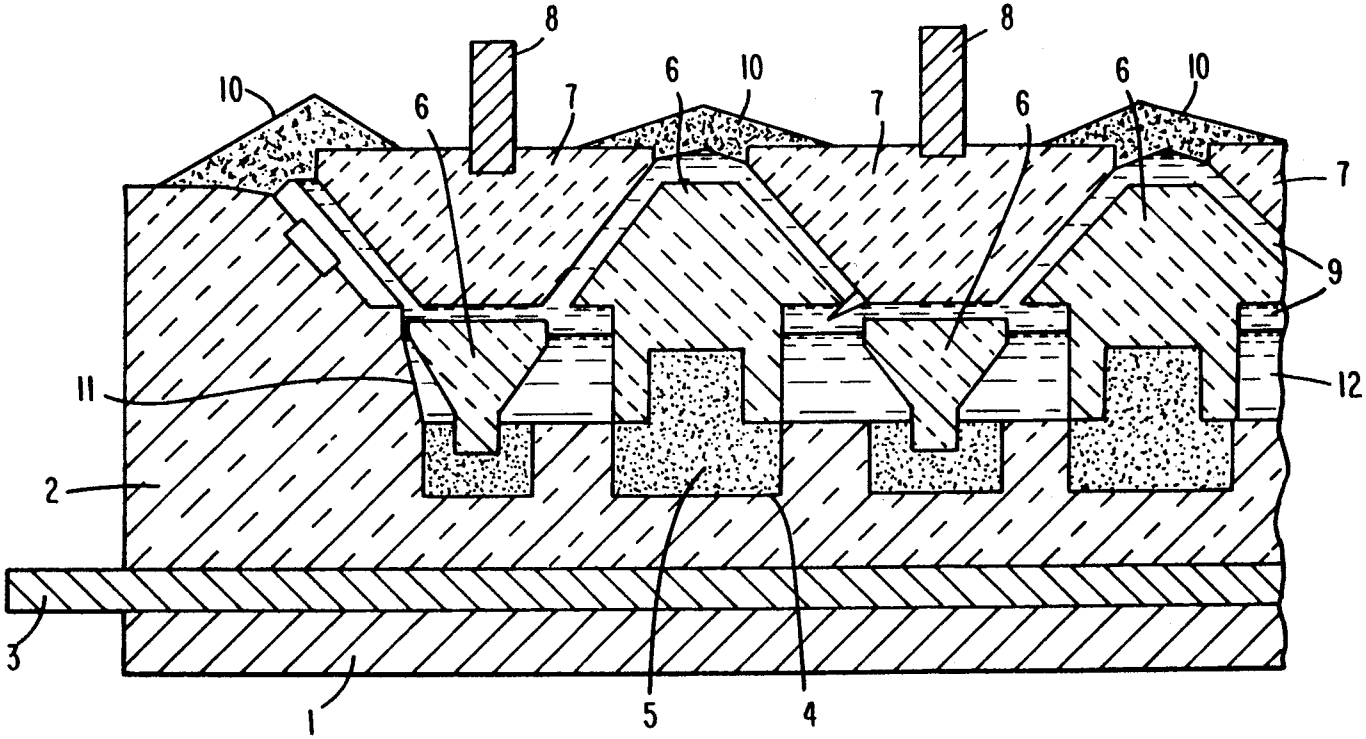
FIG. 1 is a cross-sectional view of a reduction cell according to the present invention which illustrates the inert anode and RHM cathode configuration.

The present invention is directed to an electrolysis or reduction cell for the reduction of various metals. More particularly, the present invention involves specific elements of the electrolysis or reduction cell including replaceable cathode elements. The cathode elements, which are designed to be retrofitted into existing reduction cells have working, planar surfaces and support portions which are designed to be received in refractory ceramic holders such as refractory silicon carbide materials. The refractory ceramic holders are positioned in the electrolysis cell's cathode carbon lining and provide for long term stability of the cathode element's positioning in the cathode and further allow for replacement of the cathode elements as they become worn during service.

The cathode elements of the present invention are made from refractory hard metal (RHM) including $TiB_2$, $TiB_2$-AlN, $TiB_2$-graphite and similar compositions which have been developed over the years to withstand the harsh environment of molten cryolite systems found in alumina reduction cells. Within the reduction cell a number of cathode elements are positioned so that their planar working surfaces are spaced apart and parallel to corresponding planar surfaces of anode elements which depend downwardly into the reduction cell.

Each anode has a plurality of planar working surfaces which generally define a frustum of a pyramid which may have three or more side surfaces. The anodes are inverted to depend downwardly into the reduction cell and are supported by support stems attached thereto. The cathode elements are arranged in a manner so as to provide almost 100% coverage of the working surfaces of the anodes in a uniform anode-cathode spacing. In this manner each of the cathode elements include at least one planar working surface which is parallel to, spaced apart, and opposed to a working planar surface of an anode. Inasmuch as the anodes are shaped as inverted frustum of pyramids, the cathodes include working parallel surfaces which are either horizontal with respect to the orientation of the alumina reduction cell, that is perpendicular to the inverted direction of the anodes, or have working planar surfaces which are inclined so as to be parallel to the pyramidal side surfaces of the anodes.

The anodes have working surfaces which are made from a conductive ceramic material which is inert to the corrosive cryolite environment and therefore not consumed in the reduction process. A conductive ceramic surface of the anodes may result from the entire anode being made from a conductive ceramic material or, in another embodiment, may involve a metallic anode substrate which includes a conductive ceramic coating on the surface thereof.

In order to increase the efficiency of the electrolysis cell the anode-cathode separation distance, that is the distance between the corresponding planar working surfaces, is maintained between 1 to 0.5 inch. This anode-cathode separation distance for each inert anode is monitored and constantly maintained in the electrolysis cell by monitoring the voltage drop on each individual anode and altering the anode-cathode distance by individual motors connected to the anode stems as required when the voltage drop is outside of predetermined limits.

The inclined, planar working surfaces of the cathodes include grooves which are aligned in the direction of inclination. These grooves are designed to provide for controlled release of anode gases generated during the electrolysis at reduced anode-cathode separation distances in order to reduce cell resistance due to the anode gases. The grooves also increase the mass transfer of alumina into the cell's reaction zones. The grooves in the inclined planar working surfaces of the cathodes likewise provide for removal of aluminum metal produced on the cathode working surfaces which aids in reducing the reoxidation of metal produced in the cell.

By being made of a RHM material, the surfaces of the cathode elements are easily wetted by produced aluminum which flows from the inclined surfaces into a capture area in the lower part of the reduction cell. By being held in position in the cathode by refractory holder materials such as silicon nitride bonded silicon carbide and similar materials, deterioration of the cathode lining due to the formation of aluminum carbide is prevented.

In operation, alumina is added to the cell between the inert anodes by a system of point feeders and/or bar breakers. This alumina management system prevents the excess accumulation of alumina which can cause the formation of highly resistant layer of muck on the cathode surface; and provides for a uniform delivery of alumina to the electrolysis cell as required by the process.

FIG. 1 illustrates a cross-sectional view of an alumina reduction cell according to the present invention. As illustrated in FIG. 1 the aluminum reduction cell is supported on an insulation material 1, such as alumina and consists of a carbon cathode lining 2, which forms the bottom of the reduction cell. An electrical current collection bar 3, made from a material such as steel which is adapted to make good electrical contact with a carbonaceous cell liner is positioned within the carbon cathode lining.

The cell includes suitable bores 4 in the floor thereof as illustrated, which contain refractory holders 5 which in turn support the cathode elements 6. These refractory holders are made from silicon carbide, silicon nitride bonded silicon carbide and similar materials and allow for replacement of the cathode elements as they become worn during service. However, these holders are not essential.

As illustrated in FIG. 1 a number of anodes 7 depend downwardly into the cell by stem means 8 attached to the anodes. The anode surfaces define an inverted frustum of a pyramid shape for the anodes wherein the downward facing planar surfaces are the working surfaces which are exposed to the cryolite bath 9. The anodes may include 3 or more side surfaces with 4 or 5 surfaces being preferred. The cathode elements as illustrated include a number of cathodes which have one or more planar working surface which are arranged so as to be uniformly spaced apart and parallel to the working surfaces of the anode elements. In a preferred embodiment the anode-cathode separation distance is between about 1.0 to 0.5 inches. This distance is monitored by monitoring the voltage drop on each of the individual anode stems and controlled by individual motors (not shown) which are connected to and mechanically position the anodes by raising and/or lowering the anode stems.

FIG. 1 illustrates an alumina reduction cell in operation. As illustrated, a cryolite 9 bath is contained in the space between the anode and cathodes. On the top of the cell an alumina crust 10 feeds into the cryolite bath. Below and adjacent to the cathodes is a sump 11 in which produced aluminum 12 settles and is collected.

Figure 2:
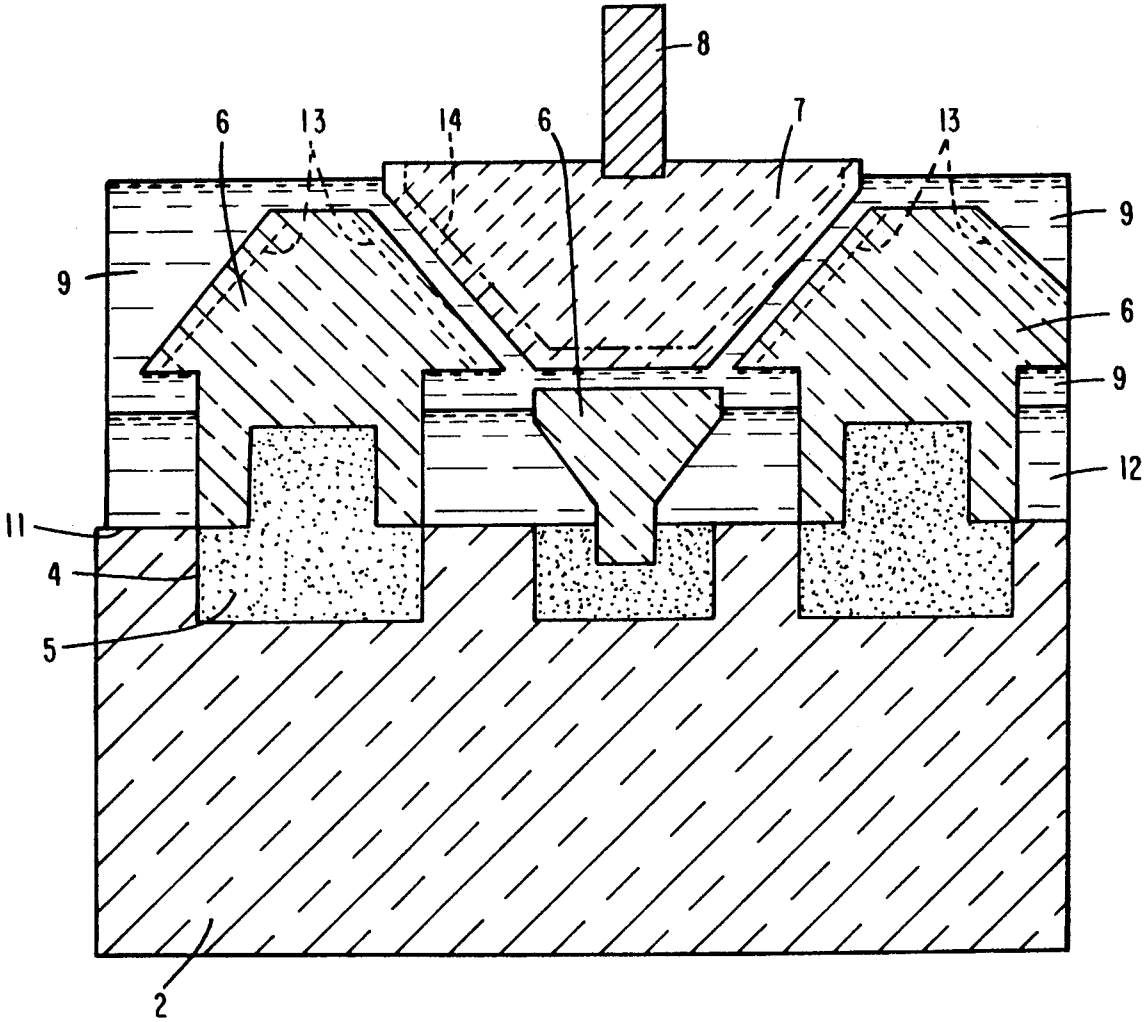
FIG. 2 is an enlarged cross-sectional view of a reduction cell according to the present invention which shows details of the inert anode and RHM cathode configuration.

FIG. 2 illustrates an enlarged cross-sectional view of the reduction cell. As illustrated in FIG. 2 the cathode elements include grooves 13 which are in the inclined surfaces thereof and are aligned in the direction of inclination. The grooves which may have any cross-sectional configuration including V shaped, U shaped, rectangular shaped, etc. These grooves provide for the controlled release of anode gases formed during the reduction and thereby reduce the cell resistance due to the anode gases and hence increase the efficiency of the cell. Additionally, the grooves help increase mass transfer of alumina into the cell's reaction zone during operation of the cell.

The anode elements which depend downwardly from the stem include inert solid surfaces. These anodes may be made entirely from a solid inert material such as a conductive ceramic material inert to the corrosive cryolite environment or, as illustrated in FIG. 2, may be made from a metallic substrate having an inert coating 14 thereon.

The illustrated figures show only a portion of a reduction cell. As is clear from the illustrations, the cell may have any number of anode elements but must include at least one anode. The number of cathode elements and their arrangement are selected so that each planar working surface of the anodes is spaced apart and parallel to a corresponding working surface of a cathode. Thus, the arrangement of anode elements and cathode elements may include any array of elements from a single anode, to a linear arrangement of anodes, to a matrix arrangement of anodes.

Thus, the present invention is directed to a reduction cell for use in the electrolytic production of metals from molten solutions. The reduction cell includes at least one anode having a plurality of planar surfaces which generally define an inverted frustum of a pyramid and a plurality of cathodes elements. Each cathode element has at least one planar surface which is spaced apart from and parallel to a corresponding planar surface of at least one anode such that there is a corresponding parallel surface of a cathode element for each planar surface of every anode.

The cathode elements can have inclined surfaces or a combination of inclined and horizontal planar surfaces. Planar surfaces of the cathode elements which are spaced apart from and parallel to corresponding inclined surfaces of the anodes include grooves therein which are aligned in the direction in which the surfaces are inclined.

There can be any number and matrical arrangement of the anodes. In embodiments wherein a plurality of anodes are utilized each of the plurality of cathode elements are positioned between adjacent anodes.

In order to maintain a stable cathode-anode separation distance the anodes have surfaces which are made from an inert material. In one embodiment the anodes are made entirely from an inert material while in another embodiment the anodes are made from a metallic material and merely have inert surface coatings or layers.

Each of plurality of cathode elements are supported in the reduction cell by ceramic holder means which are generally located on lower surfaces of the cathode elements. The ceramic holder means are preferably made from a silicon carbide material and more preferably made from silicon nitride bonded silicon carbide.

In order to improve efficiency, the cathode elements are made from a refractory hardened metal selected from the group consisting of carbides, borides and nitrides of metals of groups IVA, IVB, VB and VIB of the periodic table. Preferred refractory hard materials for purposes of the present invention include titanium diboride, titanium diboride-aluminum nitride and titanium diboride-graphite.

The anodes are each positioned in the reduction cell by means of support stems which support the anodes. The support stems are mechanically connected to motors which are used to raise and lower the anodes as necessary to adjust the cathode-anode separation distance, which preferably is maintained between about 1.0–0.5 inches. This cathode-anode separation distance is monitored by sensing for a drop in voltage across the anodes.

The cathode elements are designed to be replaceable. In this regard, the cathode elements may be supported by the ceramic holders in the reduction cell.

In one embodiment, the replaceable cathode elements have only one planar working surface having a groove therein. In this embodiment the cathode element further has an opposed surface which comprises a holder connector means which may be either a projection or a recess.

In another embodiment the replaceable cathode elements have a plurality of working surfaces which generally define a frustrum of a pyramid having grooves in the slanted surfaces thereof. In this embodiment holder connector means is located in the base of the frustum of the pyramid.

The present invention also is directed to a method for producing a metal from a molten electrolyte, utilizing the novel cathode elements and the unique anode-cathode combination discussed above. In particular, the method involves reducing the metal from a molten electrolyte by applying an electrical potential through the molten electrolyte between at least one anode and a plurality of cathode elements, wherein each of the plurality cathode elements have at least one working surface which includes means to control the release of anode gases. The means to control the release of the anode gases is the grooves in the cathode elements. These grooves further aid in the mass transfer to components of the molten electrolyte between the cathodes and anodes. The method is particularly useful for producing aluminum from a cryolite bath.

In the method, the distance between the anodes and adjacent cathode elements is controlled by moving the individual anodes in response to a sensed voltage drop across anodes.

The inert anode and RHM cathode design of the present invention which can be retrofitted into conventional cathodes with minimum changes in cost allows room in the cathode cavity for the accumulation of daily aluminum production in the cell and subsequent removal thereof by a conventional tapping system. The design also allows room in the cathode cavity for a normal volume of cryolitic bath to maintain sufficient volume of alumina in solution for the continuation of the process without excessive anode effects Finally, the design allows control of the cell operations including cell voltage and alumina feed with established cell techniques and methods.

Although the invention has been described with reference to particular means, materials and embodiments, from the foregoing description, one skilled in the art can easily ascertain the essential characteristics of the present invention and various changes and modifications may be made to adopt the various uses and conditions without departing from the spirit and scope of the present invention as described by the claims that follow.

We claim:

1. A reduction cell for use in the electrolytic production of metals from molten solutions which comprises: at least one anode having a plurality of inclined planer surfaces and a generally horizontal planer surface which generally define an inverted frustrum of a pyramid, a plurality of cathode elements, each having at least one inclined planer surface which is spaced apart from and parallel to a corresponding inclined planer surface of said at least one anode and at least one cathode element having a generally horizontal planer surface which is spaced apart from and parallel to a corresponding generally horizontal planer surface of said at least one anode such that there is a corresponding parallel surface of a cathode element for each planer surface of said at least one anode, and wherein the inclined planer surfaces of said plurality of cathode elements which are spaced apart from and parallel to inclined surfaces of said at least one and include grooves therein which are aligned in the direction to which said surfaces are inclined.

2. A reduction cell according to claim 1, wherein said at least one anode comprises a plurality of anodes having one of said plurality of cathode elements positioned between adjacent anodes and said at least one cathode element comprises a plurality of cathode elements such of which being positioned beneath one of said plurality of anodes.

3. A reduction cell according to claim 1, wherein each of said at least one anode has a surface which is made from an inert material.

4. A reduction cell according to claim 1, wherein each of said plurality of cathode elements and each of said at least one cathode element are supported in said reduction cell by ceramic holder means.

5. A reduction cell according to claim 4 wherein said plurality of cathode elements and said at least one cathode element are made from a refractory hardened metal.

6. A reduction cell according to claim 5, wherein said refractory hardened metal is selected from the group consisting of carbides, borides and nitrides of metals of groups IVA, IVB, VB and VIB of the periodic table.

7. A reduction cell according to claim 5, wherein said refractory hardened metal is selected from the group consisting of titanium diboride, titanium diboride-aluminum nitride and titanium diboridegraphite.

8. A reduction cell according to claim 5, wherein said ceramic holder means is made from silicon carbide.

9. A reduction cell according to claim 8, wherein said silicon carbide comprises silicon nitride bonded silicon carbide.

10. A reduction cell according to claim 1, wherein said at least one anode is supported on a movable support stem.

* * * * *